US006039218A

United States Patent [19]

Beck

[11] Patent Number: 6,039,218

[45] Date of Patent: Mar. 21, 2000

[54] TAMPER-EVIDENT CLOSURE WITH ABUTMENT

[75] Inventor: Matthew R. Beck, Bloomingdale, Ill.

[73] Assignee: Innovative Plastic Technology, Inc., Austin, Tex.

[21] Appl. No.: 09/228,131

[22] Filed: Jan. 11, 1999

[51] Int. Cl.[7] ..... B67D 5/37

[52] U.S. Cl. ..... 222/153.06; 215/252; 215/253; 222/521

[58] Field of Search ..... 222/153.06, 521, 222/525, 549; 215/250, 252, 256, 253

[56] References Cited

U.S. PATENT DOCUMENTS

| | | | |
|---|---|---|---|
| 4,546,893 | 10/1985 | Stull . | |
| 4,749,103 | 6/1988 | Barriac . | |
| 4,760,941 | 8/1988 | Salmon et al. . | |
| 4,805,807 | 2/1989 | Perne et al. | 222/153.06 |
| 5,046,646 | 9/1991 | Stull . | |
| 5,072,863 | 12/1991 | Stull . | |
| 5,088,613 | 2/1992 | Dutt et al. . | |
| 5,104,008 | 4/1992 | Crisci . | |
| 5,181,632 | 1/1993 | Latter | 222/153.06 |
| 5,328,063 | 7/1994 | Beck et al. . | |
| 5,421,487 | 6/1995 | Moretti . | |
| 5,429,282 | 7/1995 | Stebick . | |
| 5,431,305 | 7/1995 | Kaminski . | |
| 5,454,476 | 10/1995 | King et al. . | |
| 5,465,876 | 11/1995 | Crisci . | |
| 5,472,120 | 12/1995 | Stebick et al. . | |
| 5,588,562 | 12/1996 | Sander et al. . | |
| 5,655,685 | 8/1997 | Carr et al. . | |
| 5,657,906 | 8/1997 | Rapchak et al. . | |
| 5,662,247 | 9/1997 | Rapchak et al. . | |
| 5,680,965 | 10/1997 | Beck . | |

*Primary Examiner*—Gregory L. Huson
*Attorney, Agent, or Firm*—Emrich & Dithmar

[57] ABSTRACT

A tamper-evident closure construction for a container with a neck having a discharge opening therein includes a base cap having a base wall and a nozzle portion projecting from the base wall and an annular flange projecting radially outwardly from the nozzle portion adjacent to the base wall and having a frustoconical first cam surface thereon and a flat planar first stop surface thereon. The construction also includes an overcap with a cylindrical, flexible and resilient skirt connected to the base wall by a circular array of frangible webs, and having a flat planar second stop surface at the distal end thereof and an annular groove mateably receiving the annular flange and defining a frustoconical second cam surface engaging the first cam surface. When the overcap is moved from the initial position along the nozzle portion and away from the base wall the frangible webs are broken, the cam surfaces flexing the overcap skirt until it clears the annular flange, whereupon it returns to an unflexed condition wherein the stop surfaces are engageable with each other to prevent return of the overcap to its initial position.

20 Claims, 3 Drawing Sheets

TAMPER-EVIDENT CLOSURE WITH ABUTMENT

BACKGROUND OF THE INVENTION

The present invention relates to container closures and, in particular, to tamper-evident closures.

It is known to provide containers with tamper-evident closures, commonly in the form of a cap, which is coupled to the container by a tamper-evident connection, such as one or more frangible elements. When the container is opened, or otherwise tampered with to the extent of moving the cap from its initial, as-fabricated position, the frangible elements break, providing a clear indication that the closure has been opened or tampered with. However, in many such devices, it is possible to return the cap to its initial position, so that it may be difficult for the casual observer to tell that the frangible elements have been broken.

It is also known to provide non-resealable closures for containers which, once unsealed, cannot easily be moved back to an initial position corresponding to the originally sealed condition, but which are not tamper-evident.

SUMMARY OF THE INVENTION

It is a general object of the invention to provide an improved tamper-evident closure construction which avoids the disadvantages of prior constructions while affording additional structural and operating advantages.

An important feature of the invention is the provision of a tamper-evident closure construction which, once having been moved from an initial position breaking the tamper-evident connection, cannot be returned to the initial position.

In connection with the foregoing feature, another feature of the invention is a provision of a tamper-evident closure construction of the type set forth, which is of a simple and economical construction.

Certain ones of these and other features of the invention may be obtained by providing a tamper-evident closure construction for use with a container of the type having a neck with a discharge opening therein, comprising: a base cap engageable with the container neck and having a first stop surface thereon, and an overcap having a flexible and resilient portion connected to the base cap in an initial position by a tamper-evident connection which is severable to permit movement of the overcap from the initial position to a second position, the overcap having a second stop surface thereon engageable with the first stop surface when the overcap is in the second position for preventing return of the overcap to its initial position.

Other features of the invention may be obtained by providing a tamper-evident closure construction of the type set forth, which includes first and second cam surfaces which cam past each other in response to movement from the initial position to the second position, flexing the flexible and resilient portion and allowing it to return to an unflexed condition when the cam surfaces clear each other, bringing the stop surfaces into position for engagement with each other.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
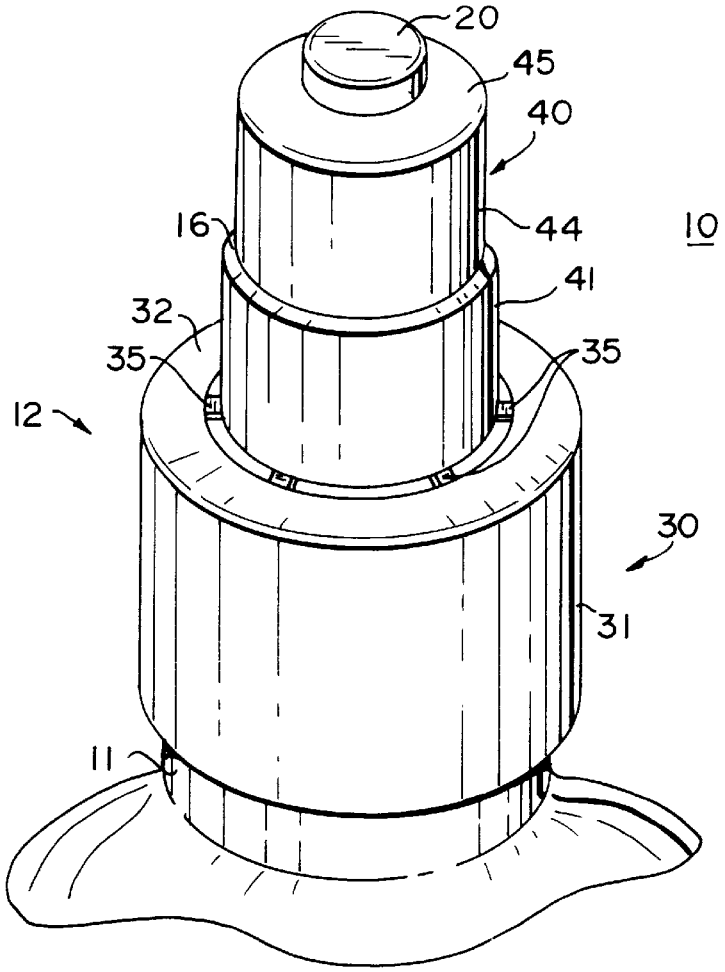
FIG. 1 is a perspective view of a closure construction in accordance with the present invention in its initial position.
Figure 2:
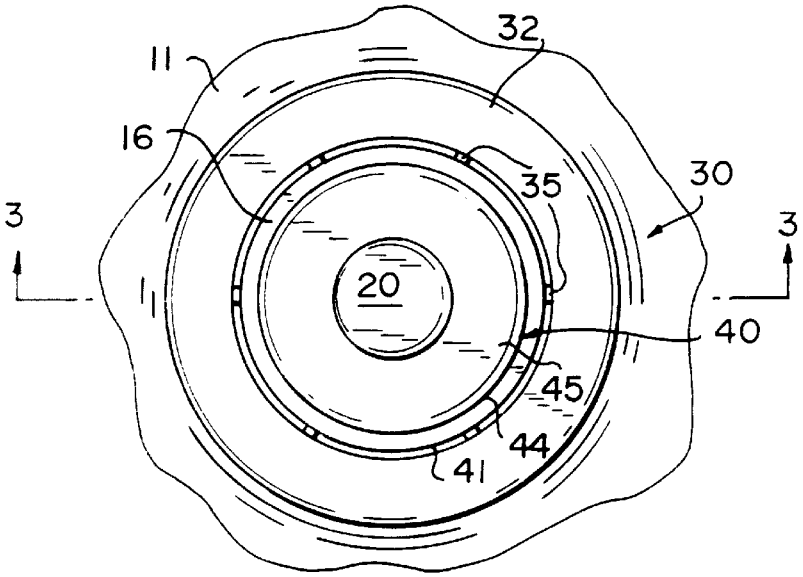
FIG. 2 is a top plan view of the closure construction of FIG. 1.

Referring to FIGS. 1–5, there is illustrated a closure construction, generally designated by the numeral 10, in accordance with the present invention, for closing a neck 11 of an associated container. The closure construction 10 is similar to that disclosed in applicant's U.S. Pat. No. 5,680,965, the disclosure of which is incorporated by reference. The closure construction 10 has a base cap 12 and an overcap 40. The base cap 12 includes an inner valve member 13 and a container connector 30.

Figure 5:
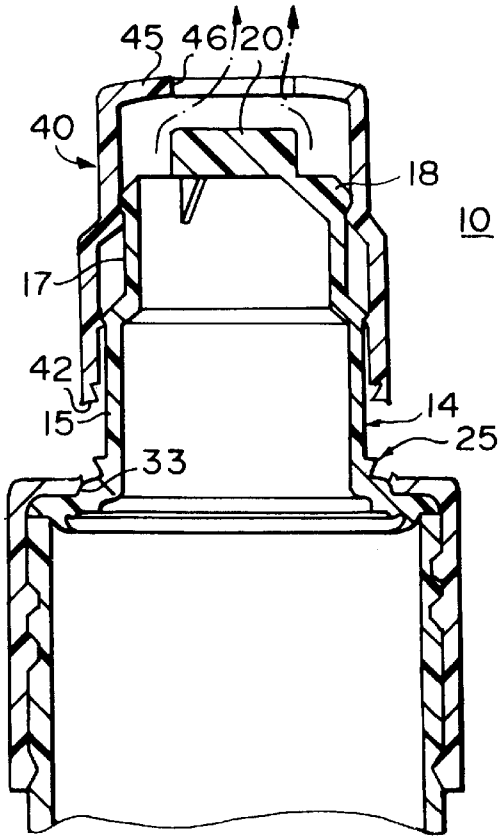
FIG. 5 is a view similar to FIG. 4, and illustrating the closure construction in a fully open condition.

The inner valve member 13 includes a generally cylindrical nozzle 14 having a main body 15 joined at its upper end by a frustoconical shoulder 16 to a reduced-diameter tip 17. The tip 17 is provided at its distal end with a radially outwardly extending annular stop bead or flange 18 (FIG. 5). The main body 15 is provided on its outer surface with a pair of laterally outwardly projecting inclined ramp beads, 19, 19*a* at diammetrically opposed locations, which preferably respectively underlie recesses (not shown), respectively defining inclined ramp surfaces bounded at their opposite ends by stop surfaces, all in a known manner.

The nozzle 14 is provided at its upper end with a centrally disposed cylindrical turret 20 having an outer diameter substantially less than the inner diameter of the tip 17. The turret 20 is disposed coaxially with the nozzle 14 and is secured to the tip 17 by a plurality of circumferentially spaced gussets 21, the annular space between the turret 20 and the tip 17 defining a discharge opening for the contents of the associated container, in a known manner. The main body 15 of the nozzle 14 is provided at its lower end with a radially outwardly extending flange 22 having an outer diameter substantially equal to that of the container neck 11 and dimensioned to seat on the upper end of the neck 11, the flange 22 being joined to the main body 15 by an annular shoulder 23. Formed on the main body 15 and projecting radially outwardly therefrom immediately above the shoulder 23 is an annular flange 25, substantially sawtooth-shaped in transverse cross section. Thus, referring also to FIGS. 6–8, it can be seen that the flange 25 defines an upwardly and outwardly inclined, frustoconical cam surface 26 and an annular stop surface 27 which lies in a plane substantially perpendicular to the longitudinal axis of the nozzle 14.

The container connector 30 has a circularly cylindrical skirt portion 31 integral at its upper end with a radially inwardly extending annular flange or base wall 32, which has a circular inner end edge 33. In use, the skirt portion 31 is threadedly engageable with the container neck 11 in a known manner, with the annular flange 32 overlying the flange 22 of the nozzle 14 and sealing it against the upper end of the container neck 11, with the end edge 33 of the container connector 30 abutting the shoulder 23 of the nozzle. If desired, a tamper-evident connection could be provided between the container connector 30 and the neck 11, as disclosed in the aforementioned U.S. Pat. No. 5,680,965.

Preferably, the container connector 30 is unitary with the overcap 40, being joined thereto by a frangible connection including a plurality of circumferentially spaced webs 35. The overcap 40 is a generally cylindrical member having a cylindrical main wall 41, the lower end of which terminates in an annular end or stop surface 42, and is joined to the frangible webs 35. The upper end of the main wall 41 is joined by a frustoconical shoulder 43 to a reduced-diameter tip 44, the upper end of which is integral with a radially inwardly extending cover flange 45 having a circular seal edge 46 which defines a discharge opening. The overcap 40 has a radially inwardly projecting annular bead 47 at the lower end of the tip 44. The main wall 41 is provided on its inner surface with a pair of laterally inwardly projecting inclined ramps 49, 49*a* at diametrically opposed locations, respectively immediately beneath the inclined ramp beads 19 and 19*a* of the nozzle 14. Preferably, the upper ends of the ramps 49 and 49*a* respectively terminate at axially extending and radially inwardly projecting stop ribs (not shown), which respectively project into the recesses in the nozzle 14 and ride along the inclined ramps defined by those recesses, all in a known manner.

The main wall 41 of the overcap 40 is provided adjacent to its lower end with an annular groove 50, which is substantially sawtooth-shaped in transverse cross section, defining an axially upwardly and radially outwardly inclined frustoconical cam surface 51 and an annular surface 52 which lines in a plane substantially perpendicular to the longitudinal axis of the overcap 40.

Figure 3:
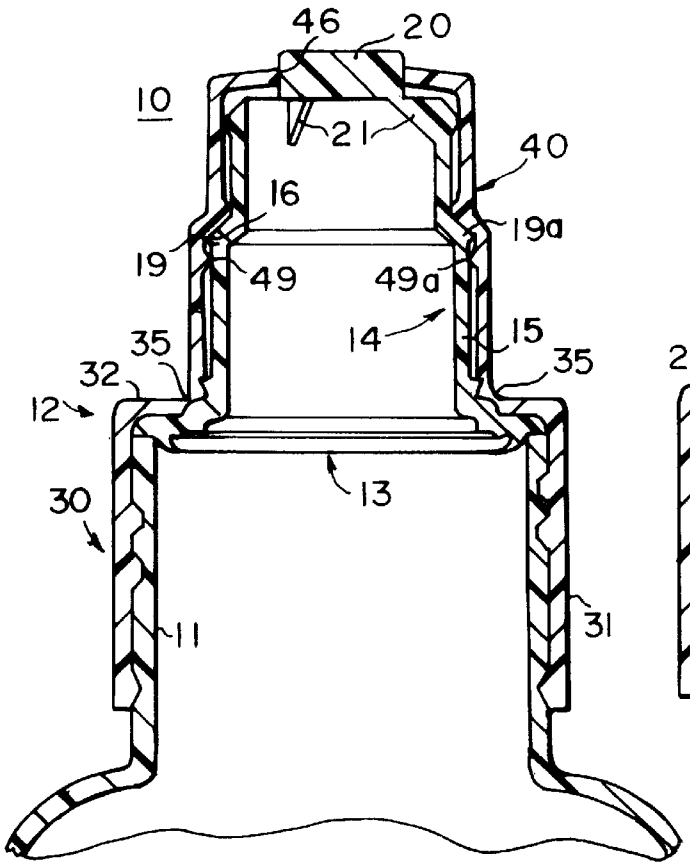
FIG. 3 is a view in vertical section taken along the line 3—3 in FIG. 2.
Figure 6:
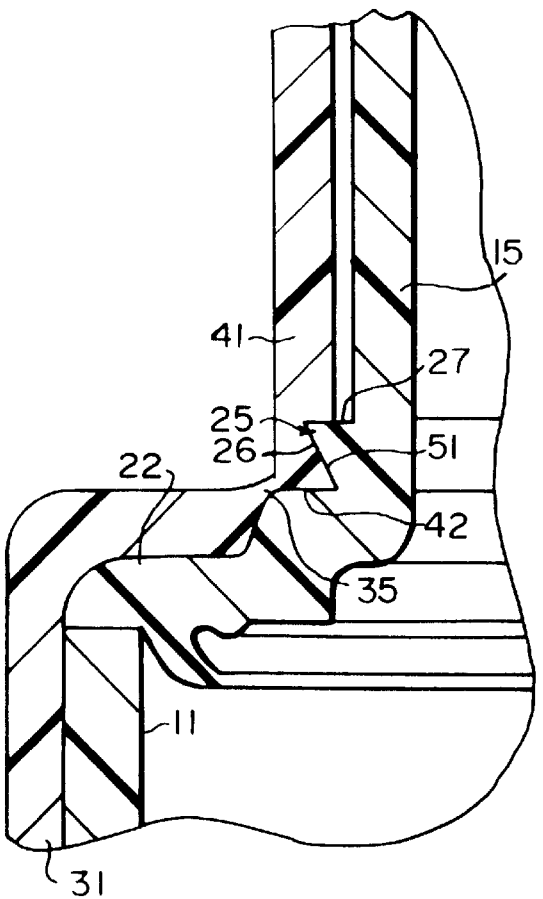
FIG. 6 is an enlarged, fragmentary view of a portion of FIG. 3, illustrating the cam and stop surfaces of the present invention.

In use, the overcap 40 fits over the nozzle 14, so that, in the as-fabricated condition, the sawtooth-shaped flange 25 of the nozzle 14 is mateably received in the groove 50 of the overcap 40, as can best be seen in FIGS. 3 and 6, with the end surface 42 of the overcap 40 seated on the shoulder 23 of the inner valve member 13. In this condition, the bead 47 of the overcap 40 is seated against the frustoconical shoulder 16 of the nozzle 14 and the seal edge 46 of the overcap 40 is disposed in sealing engagement with the outer surface of the nozzle turret 20, sealing the discharge opening.

Figure 4:
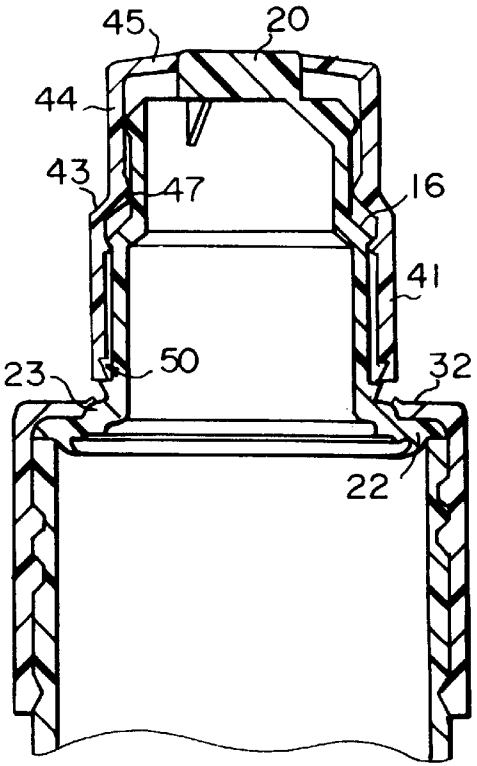
FIG. 4 is a view similar to FIG. 3, and illustrating the closure construction in a position with the frangible elements broken.
Figure 8:
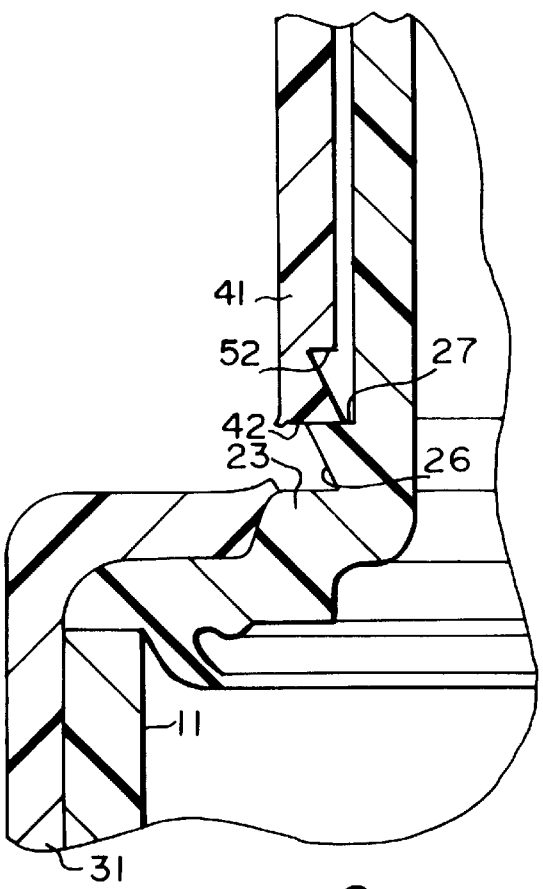
FIG. 8 is a view similar to FIG. 7, illustrating the closure construction in the position of FIG. 4.
Figure 7:
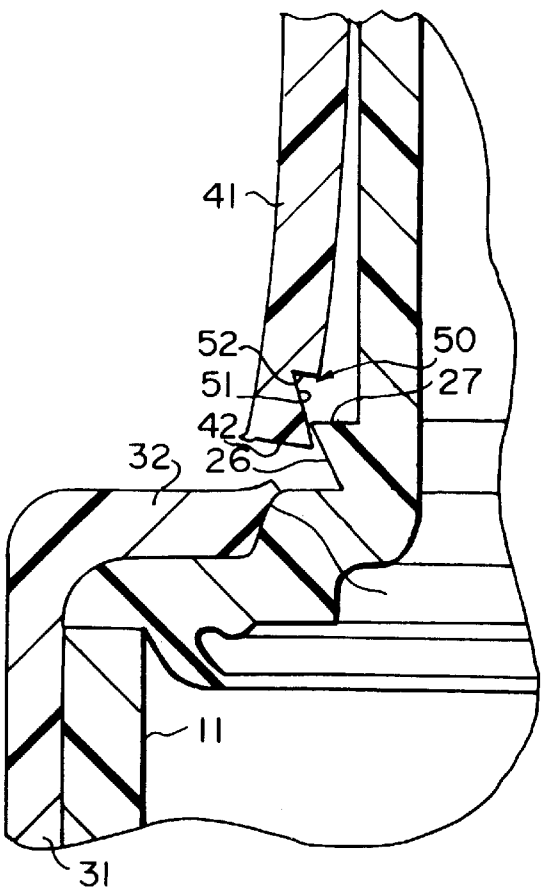
FIG. 7 is a view similar to FIG. 5, illustrating movement of the closure construction from the FIG. 6 condition.

When it is desired to discharge contents of the container, the overcap 40 is moved to an open condition, illustrated in FIG. 5, by manually rotating or twisting the overcap 40, which is guided along the inclined ramp surfaces upwardly to the open position, wherein the overcap cover flange 45 clears the nozzle 14 and opens the discharge opening to permit discharge of contents in the direction of the arrows in FIG. 5. During this initial twisting action, the frangible webs 35 are broken, to permit the overcap 40 to be opened, as illustrated in FIGS. 4, 7 and 8. Thus, there is provided a tamper-evident closure construction, since any attempt to open the overcap 40 will break the frangible webs 35, providing a clear indication that the overcap 40 has been opened or tampered with. The axial upward movement of the overcap 40 is limited by engagement of the bead 47 with the bead 18, and further by engagement of the stop ribs on the overcap 40 with the stop surfaces at the ends of the nozzle recesses (not shown), in a known manner.

Typically, the closure construction 10 is formed of a suitable plastic material, and the main wall 41 of the overcap 40 has sufficient flexibility and resilience to permit it to clear the sawtooth-shaped flange 25 on the inner valve member 13 during initial opening. More specifically, referring to FIGS. 6–8, as the overcap 40 is initially moved from the normal, as-fabricated condition of FIG. 6, the cam surface 51 on the overcap 40 cams past the cam surface 26 on the flange 15, the flexibility of the overcap 40 accommodating this movement, as is illustrated in FIG. 7. Preferably, the frangible webs will break before the overcap 40 can clear the flange 25. As soon as the cam surface 51 of the overcap 40 clears the cam surface 26 of the flange 25, the main wall 41 of the overcap 40 immediately resiliently snaps back to is undeflected position, bringing the stop surface 42 thereon into a position overlying the stop surface 27 on the flange 25, as illustrated in FIG. 8. It will be appreciated that, in this position, the stop surfaces 27 and 42 will cooperate to prevent return of the overcap 40 to the FIG. 6 position. This further ensures that the breaking of the frangible webs will be immediately evident.

From the foregoing, it can be seen that there has been provided an improved tamper-evident closure construction with frangible webs which, once having broken the webs in moving the closure from an initial, as-fabricated condition, effectively prevents return to that initial condition.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A tamper-evident closure construction for use with a container of the type having a neck with a discharge opening therein, comprising:

a base cap engageable with the container neck and having a first stop surface thereon, and an overcap having a flexible and resilient portion connected to the base cap in an initial position by a tamper-evident connection which is severable to permit movement of said overcap from said initial position to a second position, said overcap having a second stop surface thereon engageable with the first stop surface when the overcap is in the second position for preventing return of the overcap to its initial position.

2. The closure construction of claim 1, wherein said tamper-evident connection includes a plurality of frangible webs extending between said flexible and resilient portion and said base cap.

3. The closure construction of claim 2, wherein said base cap and said flexible and resilient portion are cylindrical in shape, said plurality of frangible webs being spaced around the circumference of said flexible and resilient portion.

4. The closure construction of claim 1, wherein each of said stop surfaces is a flat, planar surface.

5. The closure constriction of claim 4, wherein each of said stop surfaces is annular in shape.

6. The closure construction of claim 5, wherein the container neck has a longitudinal axis, said stop surfaces being disposed in planes substantially perpendicular to the axis.

7. A tamper-evident closure construction for use with a container of the type having a neck with a discharge opening therein, comprising:

a base cap engageable with the container neck and having a first cam surface and a first stop surface thereon, and an overcap having a flexible and resilient portion connected to the base cap in an initial position by a tamper-evident connection which is severable to permit movement of said overcap from said initial position to a second position, said overcap having a second cam surface thereon engaged with the first cam surface when the overcap is in the initial position, said flexible and resilient portion being moveable from an initial unflexed condition to a flexed condition and then back to the initial unflexed condition for allowing cammed movement of said second cam surface past said first cam surface in response to movement of said overcap to said second position, said overcap having a second stop surface thereon engageable with the first stop surface when the overcap is in the second position for preventing return of the overcap to its initial position.

8. The closure construction of claim 7, wherein the container neck has a longitudinal axis, each of said cam surfaces being inclined at an acute angle with respect to the axis.

9. The closure construction of claim 8, wherein each of said cam surfaces is annular in shape.

10. The closure construction of claim 7, wherein each of said stop surfaces is a flat, planar surface.

11. The closure construction of claim 10, wherein each of said stop surfaces is annular in shape.

12. The closure construction of claim 11, wherein the container neck has a longitudinal axis, said stop surfaces being disposed in planes substantially perpendicular to the axis.

13. The closure construction of claim 7, wherein said base cap has an annular flange substantially sawtooth-shaped in transverse cross section and defining said first cam surface and said first stop surface thereon, said flexible and resilient portion of said overcap having an annular groove formed therein substantially sawtooth-shaped in transverse cross section and defining said second cam surface thereon, said flange being mateably received in said groove when said cap in its initial position, said second stop surface constituting an end surface of said flexible and resilient portion.

14. A tamper-evident closure construction for use with a container of the type having a neck with a discharge opening therein, comprising:

a base cap having a base wall and a nozzle portion projecting from said base wall and a first stop surface on said nozzle portion, and an overcap having a flexible and resilient portion connected to the base wall in an initial position by a tamper-evident connection which is severable to permit movement of said overcap from said initial position along said nozzle portion and away from said base wall to a second position, said overcap having a second stop surface thereon engageable with the first stop surface when the overcap is in the second position for preventing return of the overcap to its initial position.

15. The closure construction of claim 14, wherein said first stop surface is disposed closely adjacent to said base wall.

16. The closure construction of claim 15, wherein said flexible and resilient portion is cylindrical in shape, said second stop surface being an end surface of said flexible and resilient portion.

17. The closure construction of claim 16, wherein said base cap has an annular flange substantially sawtooth-shaped in transverse cross section and defining said first cam surface and said first stop surface thereon.

18. The closure construction of claim 14, wherein each of said stop surfaces is annular in shape.

19. The closure construction of claim 18, wherein each of said stop surfaces is a flat, planar, annular surface having a central axis and lying in a plane substantially perpendicular to the central axis.

20. The closure construction of claim 14, wherein said tamper-evident connection includes a plurality of frangible webs extending between said flexible and resilient portion and said base walls.

* * * * *